US007040421B2

(12) United States Patent
Egerstrom

(10) Patent No.: US 7,040,421 B2
(45) Date of Patent: May 9, 2006

(54) LIQUID DRIVEN DOWNHOLE DRILLING MACHINE

(75) Inventor: Fredrik Egerstrom, Nacka (SE)

(73) Assignee: Wassara AB, Stockholm (SE)

( * ) Notice: Subject to any disclaimer, the term of this patent is extended or adjusted under 35 U.S.C. 154(b) by 66 days.

(21) Appl. No.: 10/496,473

(22) PCT Filed: Nov. 20, 2002

(86) PCT No.: PCT/SE02/02105

§ 371 (c)(1),
(2), (4) Date: May 24, 2004

(87) PCT Pub. No.: WO03/064805

PCT Pub. Date: Aug. 7, 2003

(65) Prior Publication Data

US 2005/0011680 A1 Jan. 20, 2005

(30) Foreign Application Priority Data

Dec. 14, 2001 (SE) ..... 0104217

(51) Int. Cl.
*E21B 4/10* (2006.01)
*E21B 1/26* (2006.01)
*E21B 10/36* (2006.01)
*B23Q 5/06* (2006.01)

(52) U.S. Cl. ..... 175/296; 175/298; 175/417; 173/19; 173/91

(58) Field of Classification Search ..... 175/296, 175/298, 417; 173/91, 19
See application file for complete search history.

(56) References Cited

U.S. PATENT DOCUMENTS

| | | | | | |
|---|---|---|---|---|---|
| 2,371,248 | A | * | 3/1945 | McNamara | 173/64 |
| 2,608,180 | A | * | 8/1952 | Curtis | 173/132 |
| 2,758,817 | A | * | 8/1956 | Bassinger | 173/73 |
| 2,851,251 | A | * | 9/1958 | Mori | 173/73 |
| 2,873,093 | A | * | 2/1959 | Hildebrandt et al. | 175/92 |
| 2,947,519 | A | * | 8/1960 | Feucht | 173/73 |
| 3,978,931 | A | | 9/1976 | Sudnishikov et al. | |
| 4,103,746 | A | | 8/1978 | Reynolds | |
| 4,361,195 | A | * | 11/1982 | Evans | 175/297 |
| 4,566,546 | A | * | 1/1986 | Evans | 175/297 |
| 4,722,403 | A | * | 2/1988 | Kostylev et al. | 175/296 |
| 2004/0188146 | A1 | * | 9/2004 | Egerstrom | 175/296 |

FOREIGN PATENT DOCUMENTS

| | | |
|---|---|---|
| DE | 282742 | 3/1915 |
| DE | 299913 | 8/1917 |

* cited by examiner

*Primary Examiner*—Jennifer H. Gay
(74) *Attorney, Agent, or Firm*—Mark P. Stone

(57) ABSTRACT

In a liquid downhole drilling machine, the guiding bushing (31) for the drill bit is rotatably journaled in the housing (11, 12) and, via a one-way coupling (29), coupled to a turning sleeve (22) that has axial ridges (24) that bound a number of chambers (25, 26, 27) and form turning pistons for turning the turnable sleeve to and fro. A number of these chambers are coupled to be pressurized and depressurized simultaneously with said pressure chamber (47) with the piston area (46) for urging the piston hammer (30) forwards. As a result, the drill bit (13) will be indexed a defined angle between each impact so that the button inserts of the drill bit will change contact points with the rock between every impact and fragment the rock efficiently. The drill tube is not rotated.

1 Claim, 3 Drawing Sheets

Figur 1a
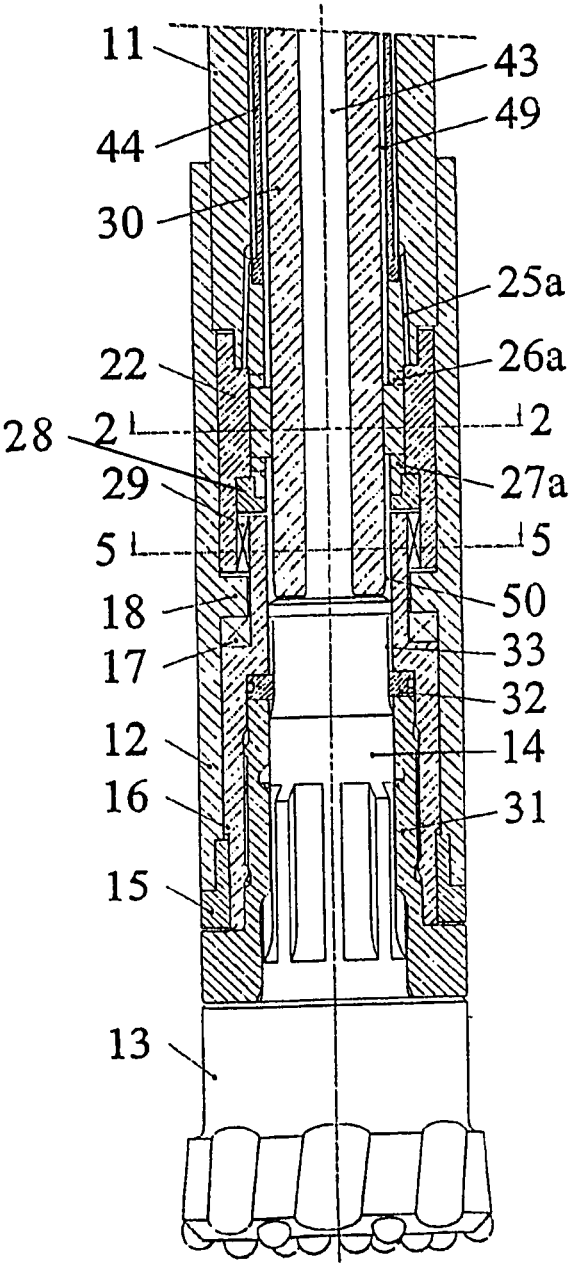
Figur 1b
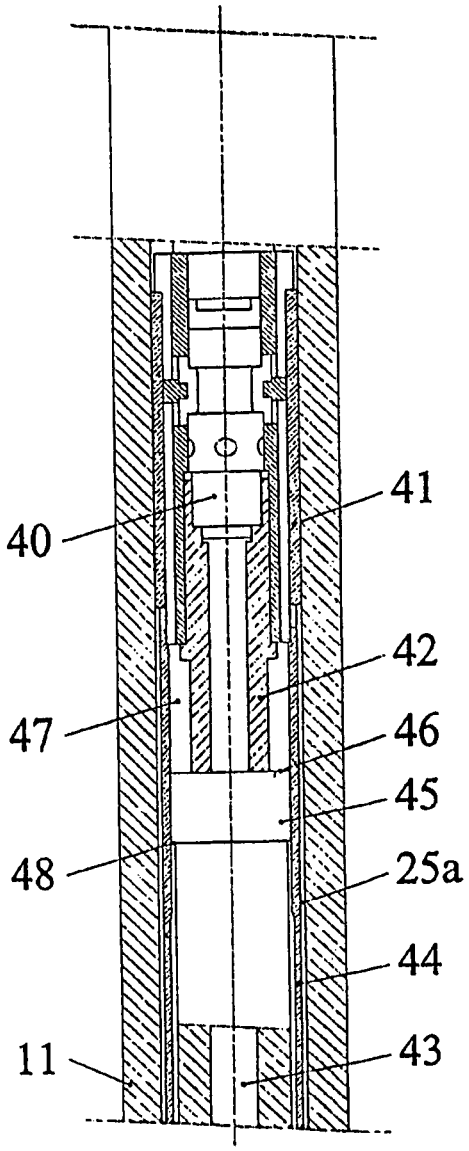

Figur 2
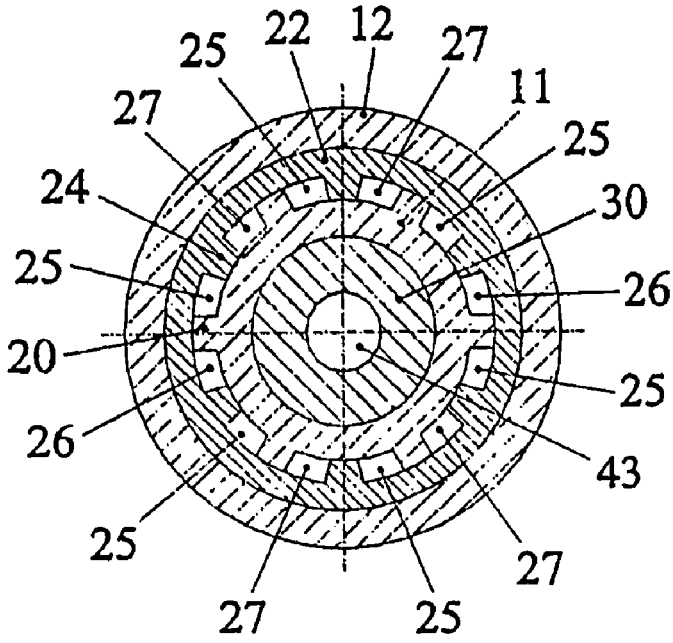
Figur 5
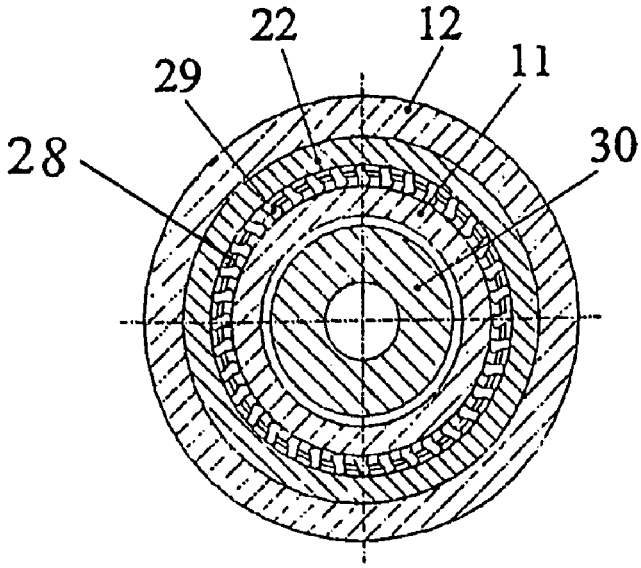

Figur 3
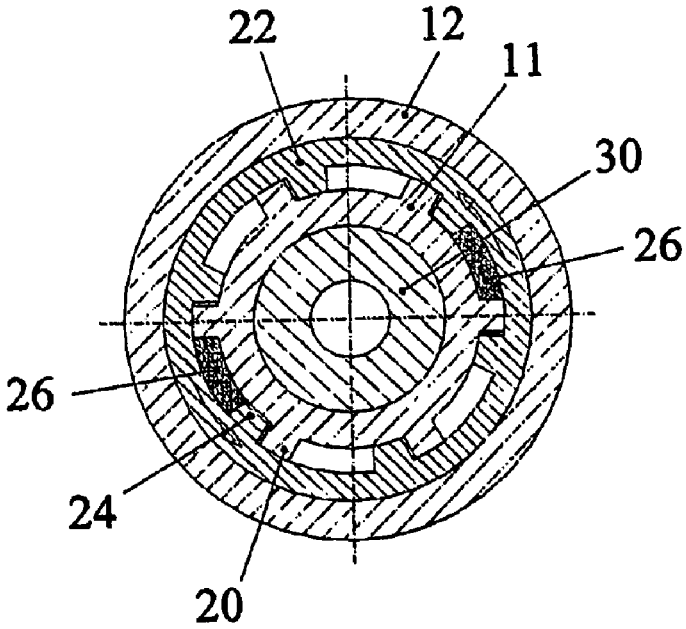
Figur 4
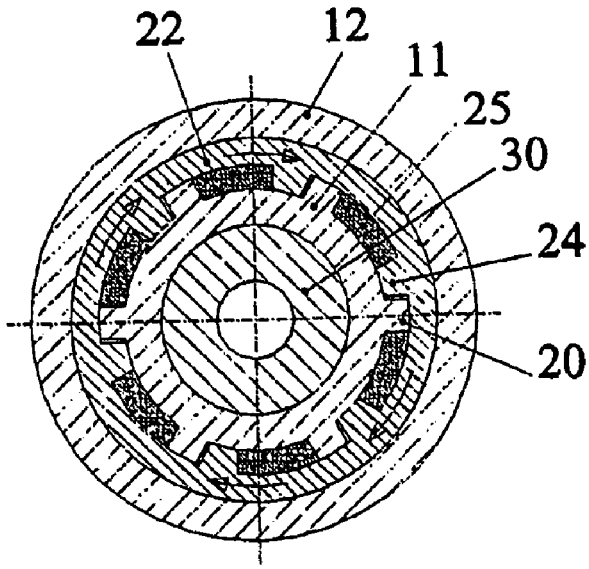

LIQUID DRIVEN DOWNHOLE DRILLING MACHINE

TECHNICAL AREA OF THE INVENTION

This invention relates to a liquid driven downhole drilling machine comprising a housing, a drill bit mounted in a guiding bushing to be angularly fixed but axially limitedly movable thereto, a piston hammer arranged to impact on a shank of the drill bit, and a valve for controlling reciprocation of the hammer piston, the valve alternately pressurising and depressurising a pressure chamber in which there is a piston area that urges the hammer piston forwards when the chamber is pressurised.

BACKGROUND OF THE INVENTION

Liquid driven downhole drilling machines of this kind are often used with drill tubes that are added to one another and the thus formed drill string is rotated so that the drilling machine and thereby the drill bit is indexed between each impact of the piston hammer. The drill bit is angularly fixed in the housing. When deep holes are drilled, although the rotation of the upper end of the drill tube is continuous, the friction between the drill tube and the borehole wall will sometimes make the rotation of the lower end of the drill tube uneven. The drill tube will act as a torsion spring and instead of being indexed evenly between the impacts of the piston hammer, the drilling machine will not be turned while there are several impacts and then it will be rapidly turned. This slip-stick effect reduces the drilling rate and increases the drill bit wear.

In liquid driven downhole drilling machines, the power liquid is supplied through the drill tube and the return stroke of the piston hammer is retarded hydraulically which induces pressure spikes since the piston hammer will then force liquid out into the drill tube. This will result in high stresses and also in a reduction of power efficiency. Attempts have been made to have an accumulator in direct connection to the drilling machine but hitherto there is no good solution to this problem.

OBJECT OF INVENTION

It is an object of the invention to improve the indexing between the impacts of liquid driven downhole drilling machines in use. Another object is to reduce the pressure spikes at the inlet of the power fluid to the machine and at the same time improve the power efficiency.

These objects are achieved by having the guiding bushing rotatably guided in the housing and, via a one-way coupling, coupled to a turnable sleeve that has axial ridges that bound a number of pressure chambers and forms turning pistons for turning the turnable sleeve to and fro, a number of these chambers being coupled to be pressurised and depressurised simultaneously with said pressure chamber with the piston area for urging the piston hammer forwards.

BRIEF DESCRIPTION OF THE DRAWINGS

FIG. 1*a* is a longitudinal section through the front portion of a downhole drilling machine in accordance with the invention.

FIG. 1*b* Is a longitudinal section through the rear portion of the same downhole drilling machine.

FIG. 2 is a section taken along line 2—2 in FIG. 1*a*.

FIGS. 3 and 4 are the same transverse section as FIG. 2, but they how some elements in other mutual positions.

FIG. 5 is a transverse section taken along line 5—5 in FIG. 1*a*.

DESCRIPTION OF AN ILLUSTRATED AND PREFERRED EXAMPLE OF THE INVENTION

The liquid driven downhole drilling machine shown on the figures has a machine housing that comprises a machine tube 11 the upper portion of which has a non-illustrated back head arranged to be coupled to a drill tube that supplies drive fluid, usually water or a suspension of bentonite in water. The middle portion of the downhole drilling machine is not shown. An outer tube 12 is fixedly mounted, screwed, to the front portion of the machine tube and a drill bit 13 extends with its shank 14 into the outer tube. An end sleeve 15 is screwed to outer tube 12 and clamps a follower sleeve 16 against an axial bearing 17 that takes support against an inner shoulder 18 in the outer tube 12. The follower sleeve is rotatably journaled in the outer tube 12. The forward end of the machine tube 11 has a reduced diameter and it has a plurality of ridges 20, FIG. 2. A turning sleeve 22 is journaled between the front end of the machine tube 11 and the outer tube 12. It has inward-directed ridges 24. A plurality of sealed chambers 25,26,27 are defined between the ridges 20 and 24. The axial portion of the machine tube radially inside of the ridges 20 forms a short forward guide for a piston hammer 30.

A one-way coupling 28 of a conventional type having toggle elements 29 is coupled between the follower sleeve 16 and the turning sleeve 22.

The shank 14 of the drill bit 13 has a splined connection with a guiding bushing 31 that is screwed to the follower sleeve 16 and clamps a stop ring 32 axially against shoulder on the follower sleeve. The stop ring 32 is axially split so as to mountable and it extends into a recess 33 in the shank of the drill bit so that it prevents the drill bit from falling out but allows a limited axial movement of the drill bit. The drill bit has an non-illustrated central channel for conveying flushing water to grooves in the front end of the drill bit.

In the front end of the machine tube 11, there is a valve 40 in a valve housing 41 and the valve housing has a tube 42 that extends into the longitudinal channel 43 of the piston hammer 30. The non-illustrated back head of the machine clamps the valve housing against a distance sleeve 44 that takes support with its forward end against a shoulder in the machine tube 11. The distance sleeve 44 seals against the machine tube 11 and it has longitudinal grooves that form a number of channels 25*a* between the distance sleeve and the machine tube. The piston hammer 30 has a head 45 that is guided both exteriorly in the distance sleeve 44 and interiorly on the tube 42. The piston is thus guided only by short guiding areas at its ends and a major part of the length of the piston is unguided since there is an annular space 49 between the piston and the distance sleeve 44. Behind the head 45 of the piston hammer is formed an annular piston surface 46 in an annular cylinder chamber 47 (pressure chamber) and the head forms a smaller annular piston surface 48 in the cylinder chamber 49 (pressure chamber) that is formed in the space that extends all the way between the two guiding areas of the piston hammer. The cylinder chamber 49 is constantly coupled to the high pressure liquid through channels that are parallel with the channels 25*a* so as to provide constantly a rearward-directed force on the on the piston whereas the valve 40 alternately connects the cylinder chamber 47 to the high pressure liquid and to the tube 42 that is connected to the flushing grooves in the drill bit via the through channel 43 of the piston. The tube 42 has thus always low pressure and the out-flowing liquid is used to flush the debris out of the borehole. Since the piston area 46 is much greater than the piston area 48, the piston hammer will reciprocate and impact on the shank of the drill bit with a frequency that can be for example 100 Hz.

The channels 25*a* lead from the cylinder chamber 47 to the six chambers 25 in FIG. 2 so that these chambers 25 will be alternately pressurised and depressurised. Ports 26*a* lead from the constantly pressurised cylinder chamber 49 to the two chambers 26 in FIG. 2 so that these chambers 26 will be constantly pressurised and ports 27*a* connects the four chambers 27 to the chamber 50 that is formed at the end surface of the drill bit shank. The four chambers 27 are therefore constantly depressurised.

FIG. 3 shows the position of turning of the turning sleeve 22 when the chambers 25 have low pressure. The two chambers 26 are the only chambers that are pressurised and the sleeve 22 has therefore turned counterclockwise into its end position in which its ridges 24 take support against the ridges 20 of the machine tube 11.

FIG. 4 shows the position of turning of the turning sleeve 22 when not only the two chambers 26 but also the four chambers 25 are pressurised. The two chambers 26 tend to turn counter-clockwise but the six chambers 25 tend to turn clockwise, and the force from the four chambers has therefore turned the turning sleeve 22 clockwise into the end position in which its ridges take support against the ridges of the machine tube.

The turning sleeve 22 will thus be turned to and fro trigged by the pressure at the rear piston surface of the piston hammer, that is, it is trigged by the impact cycle of the hammer. Since the reverse prevention device 29, the one-way clutch, couples the turning sleeve 22 with the follower sleeve 16, the latter will rotate clockwise relative to the machine tube 11. The follower sleeve will follow the turning clockwise of the turning sleeve but stand still during the turning counter-clockwise of the turning sleeve. As a result, the drill bit 31 will turn a defined angle (be indexed) between each impact so that the button inserts of the drill bit will change their points of contact with the rock between every impact and they will fragment the rock efficiently. The drill tube need therefore not be rotated and instead of extension tubes, a coil tubing can be used, that is, a bendable drill tube without joints, which can be uncoiled from a coil.

When the piston hammer is in its rearward stroke and the valve 40 switches to its position for pressurising the rear cylinder chamber 47, the piston hammer will be retarded by this pressure and turn into its forward stroke. During the retardation of the piston, the cylinder chamber 47 will reduce in volume and the drive liquid will be forced out of the chamber, which will result in a pressure increase and power loss because of the flow. The six chambers 25 of the turning device are coupled to the cylinder chamber 47 and they can therefore take up the liquid forced out of cylinder chamber, which reduces the losses and at the same time makes the turning efficient. The need for an accumulator at the inlet of the impact motor is reduced as well.

In the chosen pattern of pressure chambers 25,28,27 and turning pistons 24 with twelve pressure chambers, there will be symmetry with respect to the turning forces and the radial forces, which reduces the bearing forces in the sleeve 5. Another pattern can be chosen and still the turning pressure chambers can be coupled to the pressure chamber for driving the piston hammer forwards. The invention can be applied to piston hammers that are driven by another principle than the one that applies alternating pressure for the work stroke of the piston and constant pressure for the return stroke.

The invention claimed is:

1. Liquid driven downhole drilling machine comprising a housing (11, 12), a drill bit (13) mounted in a guiding bushing (31) to be angularly fixed but axially limitedly movable thereto, a piston hammer (30) arranged to impact a shank (14) of the drill bit, and a valve (40) for controlling reciprocation of the piston hammer, the valve alternately pressurising and depressurising a pressure chamber (47) in which there is a piston area (46) that drives the piston hammer forwards when the chamber is pressurised, wherein the guiding bushing (31) is rotatably guided in the housing (11, 12) and, via a one-way coupling (29), coupled to a turnable sleeve (22) that has axial ridges (24) that bound a number of chambers (25, 26, 27) and form turning pistons for turning the turnable sleeve in a first and second direction, a number of these chambers being coupled in parallel with said pressure chamber (47) so as to be pressurised and depressurised simultaneously therewith.

* * * * *